US009113714B2

(12) United States Patent
Natuzzi

(10) Patent No.: US 9,113,714 B2
(45) Date of Patent: Aug. 25, 2015

(54) DEVICE FOR THE MOVEMENT OF RESTING COMPONENTS OF A SOFA, A CHAIR AND THE LIKE

(71) Applicant: NATUZZI S.P.A., Santeramo in Colle (BA) (IT)

(72) Inventor: Pasquale Natuzzi, Santeramo in Colle (IT)

(73) Assignee: NATUZZI S.P.A., Santeramo in Colle (BA) (IT)

( * ) Notice: Subject to any disclaimer, the term of this patent is extended or adjusted under 35 U.S.C. 154(b) by 0 days.

(21) Appl. No.: 14/353,803

(22) PCT Filed: Oct. 24, 2012

(86) PCT No.: PCT/IB2012/055847
§ 371 (c)(1),
(2) Date: Apr. 24, 2014

(87) PCT Pub. No.: WO2013/061259
PCT Pub. Date: May 2, 2013

(65) Prior Publication Data

US 2014/0312660 A1 Oct. 23, 2014

(30) Foreign Application Priority Data

Oct. 26, 2011 (IT) ..... RM20110166 U

(51) Int. Cl.

| | |
|---|---|
| ***A47C 1/031*** | (2006.01) |
| ***A47C 1/035*** | (2006.01) |
| ***A47C 1/034*** | (2006.01) |
| ***A47C 1/037*** | (2006.01) |

(52) U.S. Cl.
CPC ..... *A47C 1/035* (2013.01); *A47C 1/037* (2013.01); *A47C 1/0342* (2013.01)

(58) Field of Classification Search
CPC .... A47C 1/0342; A47C 1/035; A47C 1/0355; A47C 1/037
See application file for complete search history.

(56) References Cited

U.S. PATENT DOCUMENTS

| | | | | |
|---|---|---|---|---|
| 2,491,898 | A * | 12/1949 | Luketa | 297/330 |
| 3,871,704 | A * | 3/1975 | Shoemaker et al. | 297/61 |
| 3,937,518 | A * | 2/1976 | Harrison | 297/61 |
| 4,365,836 | A | 12/1982 | Jackson et al. | |
| 5,310,243 | A * | 5/1994 | Pine | 297/61 |
| 5,340,191 | A * | 8/1994 | May | 297/61 |
| 7,669,921 | B2 * | 3/2010 | Hoffman et al. | 297/61 |

(Continued)

FOREIGN PATENT DOCUMENTS

| | | | |
|---|---|---|---|
| DE | 10033670 | A1 | 2/2001 |
| DE | 202006002589 | U1 | 7/2006 |

(Continued)

*Primary Examiner* — Philip Gabler
(74) *Attorney, Agent, or Firm* — Lucas & Mercanti, LLP

(57) ABSTRACT

The present invention relates to a device for the movement of resting components of a sofa, an armchair or the likes, such as a headrest movable between a lowered position and a raised position, a back movable between a substantially erected configuration and a downwardly inclined configuration, a seat movable between a backward position and a forward position, and a footrest movable between a lowered, substantially vertical position and a raised position. Such a device comprises a telescopic member equipped with a movable portion controlled by a motor and able, jointly with further connection members, to place in reciprocal relation and to move said headrest, back, seat and footrest.

6 Claims, 3 Drawing Sheets

(56) References Cited

U.S. PATENT DOCUMENTS

| | | | | |
|---|---|---|---|---|
| 8,434,822 | B2 * | 5/2013 | Asbjornsen | 297/316 |
| 8,590,964 | B2 * | 11/2013 | Murphy et al. | 297/85 R |
| 2008/0012397 | A1 * | 1/2008 | Buchholz | 297/85 |
| 2013/0140856 | A1 * | 6/2013 | Murphy et al. | 297/61 |

FOREIGN PATENT DOCUMENTS

| | | | |
|---|---|---|---|
| DE | 202006010070 | U1 | 9/2006 |
| EP | 2356922 | A1 | 8/2011 |

* cited by examiner

DEVICE FOR THE MOVEMENT OF RESTING COMPONENTS OF A SOFA, A CHAIR AND THE LIKE

CROSS-REFERENCE TO RELATED APPLICATIONS

This application is a 371 of PCT/IB2012/055847, filed Oct. 24, 2012, which claims the benefit of Italian Patent Application No. RM2011U000166, filed Oct. 26, 2011, the contents of each of which are incorporated herein by reference.

FIELD OF THE INVENTION

The present invention relates to the field of tilting seating systems, such as sofas, armchairs or the likes.

In particular, the present invention relates to a device for the movement of resting components of a sofa, an armchair or the like.

PRIOR ART AND OBJECT OF THE INVENTION

The known devices used for this purpose comprise two or more electric motors.

In fact, solutions are known with two electric motors able to control, respectively, the movement of the headrest and of the unit composed of the back, seat and footrest.

Devices of this type equipped with more than two motors, each of which is dedicated to the movement of one of the resting components, that is to say the headrest, the back, the seat and the footrest, are also known.

The main disadvantages of both the above-mentioned known solutions lie in the structural complexity and in the high production costs thereof.

Seating systems in which the headrest and the unit formed by the back, seat and footrest are only connected via leverages also exist on the market; such a connection, however, results in considerable limitations caused principally by the relative assembly constraints.

The object of the present invention is to provide a device for the movement of resting components of a sofa, an armchair or the like, which makes it possible to overcome the disadvantages and drawbacks discussed with reference to the prior art and which is easy to produce, is economical, of reliable use and of reduced structural complexity.

This object is fully achieved by a device for the movement of resting components of a sofa, an armchair or the like, such as a headrest that is movable between a lowered position and a raised position, a back that is movable between a substantially erected configuration and a downwardly inclined configuration, a seat that is movable between a backward position and a forward position, and a footrest that is movable between a lowered, substantially vertical position and a raised position, said structure being characterised in that it comprises a telescopic member equipped with a movable portion controlled by a motor and able, jointly with further connection members, to place in reciprocal relation and to move said headrest, back, seat and footrest; said telescopic member being movable between three different configurations: a first configuration of minimal extension of the movable portion in which the footrest is in the lowered position, the seat is in the backward position, the back is in the substantially erected configuration and the headrest is in the lowered position; a second configuration of partial extension of the movable portion in which the footrest is in the lowered position, the seat is in the backward position, the back is in the substantially erected configuration and the headrest is in the raised position; and a third configuration of maximum extension of the movable portion in which the footrest is in the raised position, the seat is in the forward position, the back is in the downwardly inclined configuration and the headrest is in the raised position.

DESCRIPTION OF THE INVENTION

Characteristics and advantages will become clearer from the following description of a preferred but not exclusive embodiment illustrated merely by way of non-limiting example, in the accompanying drawings, in which.

Figure 1:
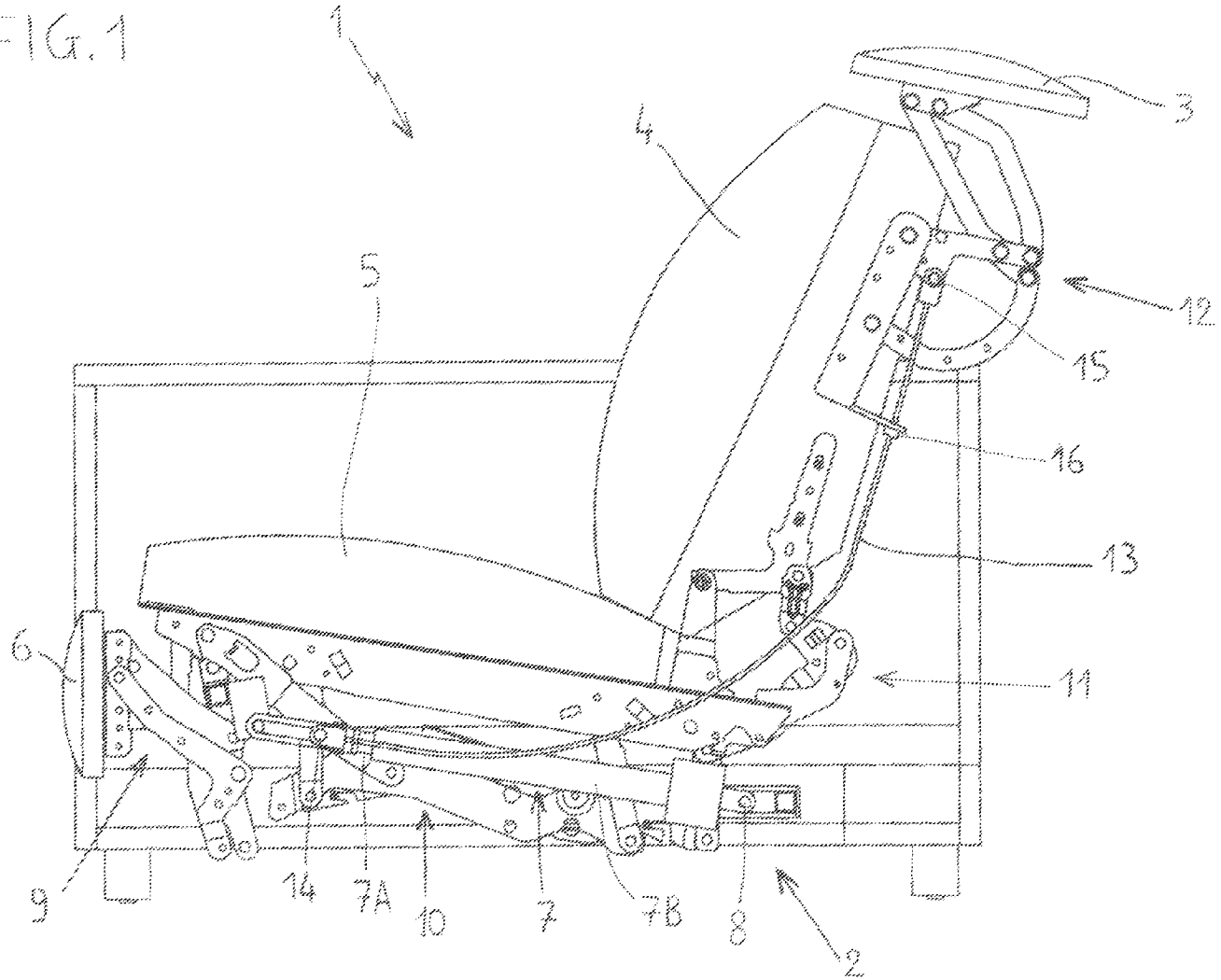
FIG. 1 shows a sofa equipped with the device for the movement of resting components of a sofa, an armchair or the likes according to the present invention in the relative fully closed configuration, that is to say with the footrest retracted, the seat backward, the back substantially erected and the headrest lowered.

With reference to the accompanying figures, 1 denotes a sofa as a whole, equipped with a movement device 2 for the movement of the resting components of said sofa 1, such as a headrest 3, a back 4, a seat 5 and a footrest 6.

The movement device 2 comprises a telescopic member 7 equipped with a movable portion 7A controlled by an electric motor—not illustrated for reasons of simplicity—and a relatively fixed portion 7B able to rotate about a fulcrum 8 integral with the device 2.

The movable portion 7A is connected apically to a hinged apparatus 9 for the movement of the footrest 6.

The movement device 2 also comprises, a seat kit 10, connected to the telescopic member 7 and to the seat 5 and provided to bring forward and backward the seat 5, and a back kit 11, connected to the telescopic member 7, to the seat 5 and to the back 4, able to vary the inclination of the back 4 in relation to the seat 5.

The two above-mentioned kits 10, 11 both comprise respective pluralities of elements hinged to one another and moved by the action of the telescopic member 7.

For the movement of the headrest 3 it is instead provided a hinged mechanism 12 fixed at two points both to the back 4 and to the headrest 3 and connected to the movable portion 7A of the telescopic member 7 by means of a flexible element 13 equipped, at respective ends, with two connection joints 14, 15.

The hinged mechanism 12 is provided with a through-hole 16 having the function of guiding the movements of the flexible element 13 during operation of the movement device 2.

The structure of the movement device 2 according to the present invention having been described, the operation thereof will now be explained.

The operation of the above-described movement device 2 allows the sofa 1 to adopt three distinct arrangements, as shown in the therein enclosed figures.

In particular, when the movable portion 7A of the telescopic member 7 is inserted within the relatively fixed portion 7B (see FIG. 1), the hinged apparatus 9 is fully retracted on itself, thus causing the footrest 6 to adopt a substantially vertical position adjacent to the seat 5 which is in turn in the backward configuration; the hinged mechanism 12 results also retracted, with the result that the headrest 3 is arranged substantially horizontally; whilst the back 4 comes to rest in a substantially erected configuration.

Figure 2:
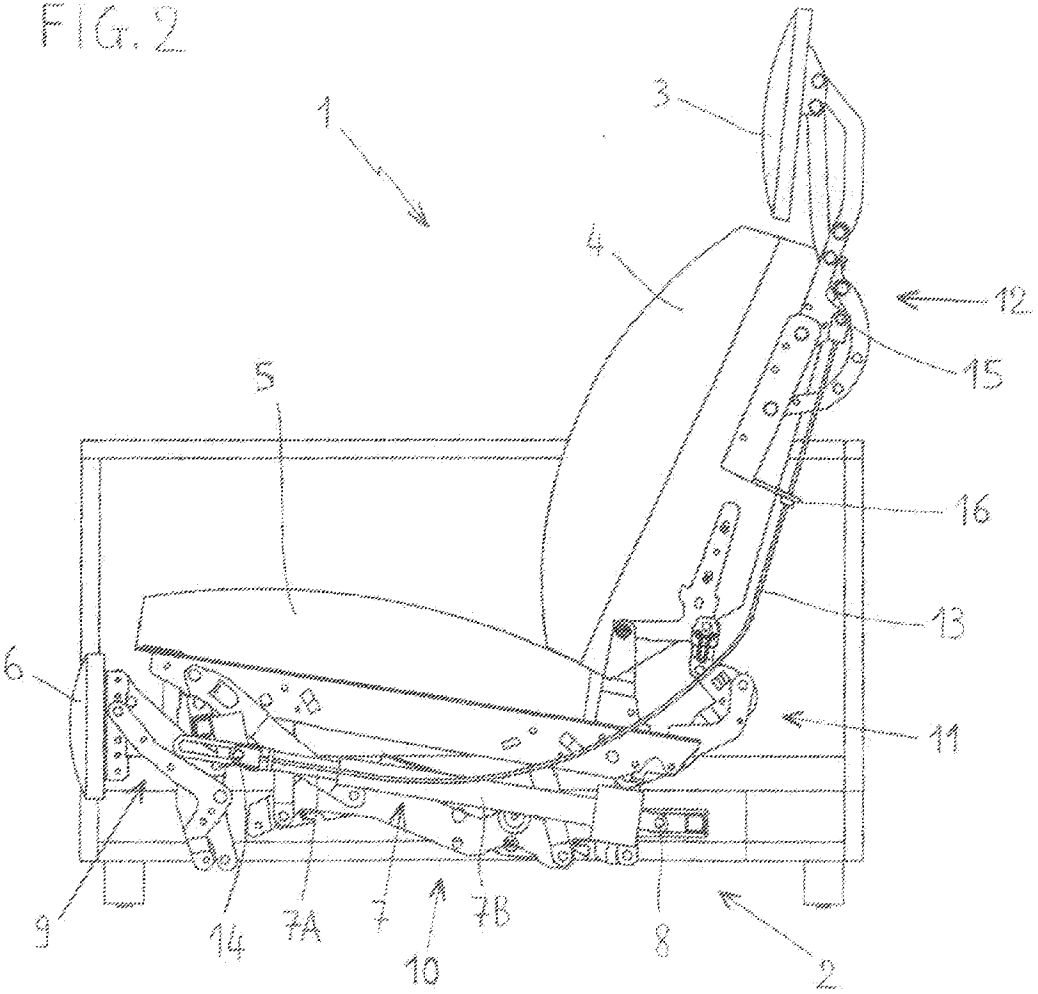
FIG. 2 shows the sofa from FIG. 1, with the aforementioned device in its intermediate configuration, that is to say with the footrest retracted, the seat backward, the back substantially erected and the headrest raised.

Thanks to a partial drawing of the movable portion 7A by means of the aforementioned electric motor (see FIG. 2), the upper end of the flexible element 13 connected to the hinged mechanism 12 moves closer to the top of the back 4, thus lengthening the hinged mechanism 12 and subsequently raising the headrest 3.

Figure 3:
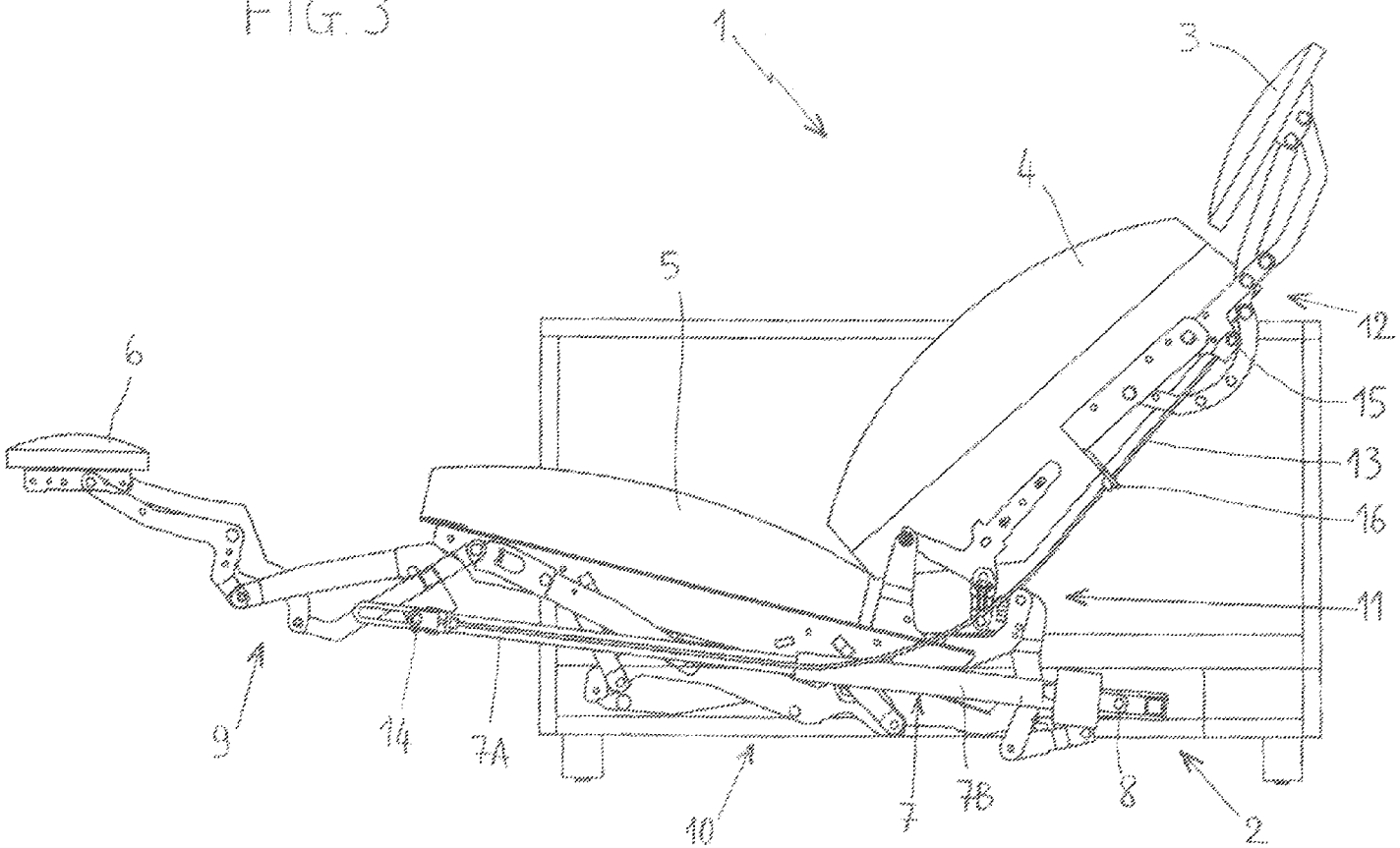
FIG. 3 shows the sofa from FIGS. 2 and 3, with the device in the fully open configuration, that is to say with the footrest raised, the seat advanced, the back downwardly inclined and the headrest raised.

The subsequent ejection of the movable portion 7A until the telescopic member 7 is maximally extended (see FIG. 3) involves, simultaneously, lengthening of the hinged apparatus 9 and correspondingly raising of the footrest 6, forwarding of the seat 5 by means of the seat kit 10, and also inclining of the back 4 downwardly thanks to the operation of the back kit 11.

The particular constructional characteristics of the movement device 2 allow the use of said device in sofas, armchairs or similar articles, having very diverse aesthetic characteristics, without any assembly constraint. Such articles equipped with the above-described device are further object of the invention.

To the above-described device for the movement of resting components of a sofa, an armchair or the likes, the skilled person in the art, with the objective of meeting further and contingent requirements, may provide numerous further modifications and variants, all however included within the scope of protection of the present invention, as defined in the accompanying claims.

The invention claimed is:

1. A device for moving resting components of a sofa, an armchair or the like, including a headrest movable between a lowered position and a raised position, a back movable between a substantially erected configuration and a downwardly inclined configuration, a seat movable between a backward position and a forward position, and a footrest movable between a lowered substantially vertical position and a raised position, said device comprising a telescopic member equipped with a movable portion controlled by a motor and capable of, jointly with a plurality of connection members, to reciprocally move said headrest, back, seat and footrest; said telescopic member being movable between three different configurations: a first configuration of minimal extension of the movable portion in which the footrest is in its lowered position, the seat is in its backward position, the back is in its substantially erected configuration and the headrest is in its lowered position; a second configuration of partial extension of the movable portion in which the footrest is in its lowered position, the seat is in its backward position, the back is in its substantially erected configuration and the headrest is in its raised position; and a third configuration of maximum extension of the movable portion, in which the footrest is in its raised position, the seat is in its forward position, the back is in its downwardly inclined configuration and the headrest is in its raised position.

2. The device according to claim 1, wherein the telescopic member is able to rotate about a fixed fulcrum in relation to said device structure.

3. The device according to claim 1, wherein the plurality of connection members comprise a hinged mechanism connected to the back and to the headrest.

4. The device according to claim 3, wherein the plurality of connection members comprise a flexible element connected to the movable portion and to the hinged mechanism by means of respective joints.

5. The device according to claim 4, further comprising at least one through-hole to guide the movement of the flexible element.

6. An armchair or sofa comprising the device according to claim 1.

* * * * *